US007412949B1

(12) United States Patent
Cillessen et al.

(10) Patent No.: US 7,412,949 B1
(45) Date of Patent: Aug. 19, 2008

(54) DUAL HEAD PISTON ENGINE

(75) Inventors: James A. Cillessen, 12421 W. 49th Ave., Unit 8, Wheat Ridge, CO (US) 80033-1922; Gabriel A. Chihoski, Golden, CO (US)

(73) Assignee: James A. Cillessen, Wheat Ridge, CO (US)

( * ) Notice: Subject to any disclaimer, the term of this patent is extended or adjusted under 35 U.S.C. 154(b) by 0 days.

(21) Appl. No.: 11/685,914

(22) Filed: Mar. 14, 2007

(51) Int. Cl.
*F02B 75/16* (2006.01)

(52) U.S. Cl. ..... 123/63; 123/196 R

(58) Field of Classification Search ..... 123/61, 123/63 R, 196 R
See application file for complete search history.

(56) References Cited

U.S. PATENT DOCUMENTS

| | | | | |
|---|---|---|---|---|
| 1,776,215 | A * | 9/1930 | Cox | 123/63 |
| 3,710,767 | A * | 1/1973 | Smith | 123/63 |
| 4,125,105 | A | 11/1978 | May | |
| 4,291,651 | A | 9/1981 | Villella | |
| 5,101,676 | A | 4/1992 | Collins | |
| 5,158,046 | A | 10/1992 | Rucker | |
| 5,233,949 | A | 8/1993 | Rucker | |
| 5,522,357 | A | 6/1996 | Nogi et al. | |
| 6,125,819 | A | 10/2000 | Strieber et al. | |
| 6,352,057 | B1 | 3/2002 | Drecq | |
| 6,748,909 | B2 | 6/2004 | Drecq | |
| 6,877,463 | B2 | 4/2005 | Moteki et al. | |
| 6,951,211 | B2 | 10/2005 | Bryant | |
| 7,039,498 | B2 | 5/2006 | Bacchi et al. | |

FOREIGN PATENT DOCUMENTS

| | | | |
|---|---|---|---|
| DE | 3921581 | A1 * | 10/1990 |
| JP | 2006038186 | | 2/2006 |

* cited by examiner

*Primary Examiner*—Noah Kamen
(74) *Attorney, Agent, or Firm*—Rick Martin; Patent Law Offices of Rick Martin, P.C.

(57) ABSTRACT

A gas or diesel internal combustion engine of either a two or four stroke design uses both ends of each piston to create a combustion chamber. The piston rod rides linearly through a lower cylinder head. The lower cylinder head forms a lower combustion chamber with its own set of valves and fuel/air inlet. A second set of lower cams and camshaft operate the lower set of valves. Crankcase oil is pumped up the middle of the piston rod to an outlet in the center of the piston.

11 Claims, 4 Drawing Sheets

DUAL HEAD PISTON ENGINE

FIELD OF INVENTION

The present invention relates to an internal combustion engine which provides each piston with a combustion chamber at each end of its stroke.

BACKGROUND OF THE INVENTION

With fuel economy a global issue for all motor vehicles, any weight reduction for the engine would increase the fuel economy. It is also desirable to reduce wear and tear on the piston, the cylinder and the piston rod with a linear movement of the piston rod. See U.S. Pat. No. 5,158,046 (1992) to Rucker. Rucker's FIG. 5 shows a two piston opposed cylinder engine with linear movement of the two piston rods.

The present invention offers the power of two pistons with each piston by firing a power stroke from both the top and bottom of each piston. The power of an eight cylinder engine can be derived from the cylinder block of a four in line cylinder block. Linear piston rod movement reduces wear and tear.

SUMMARY OF THE INVENTION

An aspect of the present invention is to provide a piston with a combustion chamber at each end, wherein the piston rod moves linearly through a seal in the lower cylinder head.

Another aspect of the present invention is to provide fuel injection, air intake and exhaust at each combustion chamber.

Another aspect of the present invention is to provide an oil inlet to each combustion chamber through a channel in the piston rod and an outlet port in the center of the piston.

Another aspect of the present invention is to provide a four stroke engine with the above features.

The embodiment displayed is a four piston, eight combustion chamber in line engine. A lower cylinder head covers the bottom of the cylinder block. The piston rods travel linearly through the lower cylinder head in a high temperature sliding seal. A crankcase has an oil pump which injects oil up through a channel in the piston rod. The piston rod channel connects to a channel across the piston. The piston has a narrowed central portion that permits the oil to exit the channel in the piston to the cylinder walls. Each combustion chamber has a fuel inlet, an air inlet and exhaust valves, an oil outlet return and a spark plug. Diesel embodiments would not need a spark plug. Any number of in line pistons could be used for an engine design. Two pistons could supply four combustion chambers in the size and approximate weight of a two cylinder engine. The design shown herein supplies eight combustion chambers in the size and approximate weight of a four cylinder engine.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
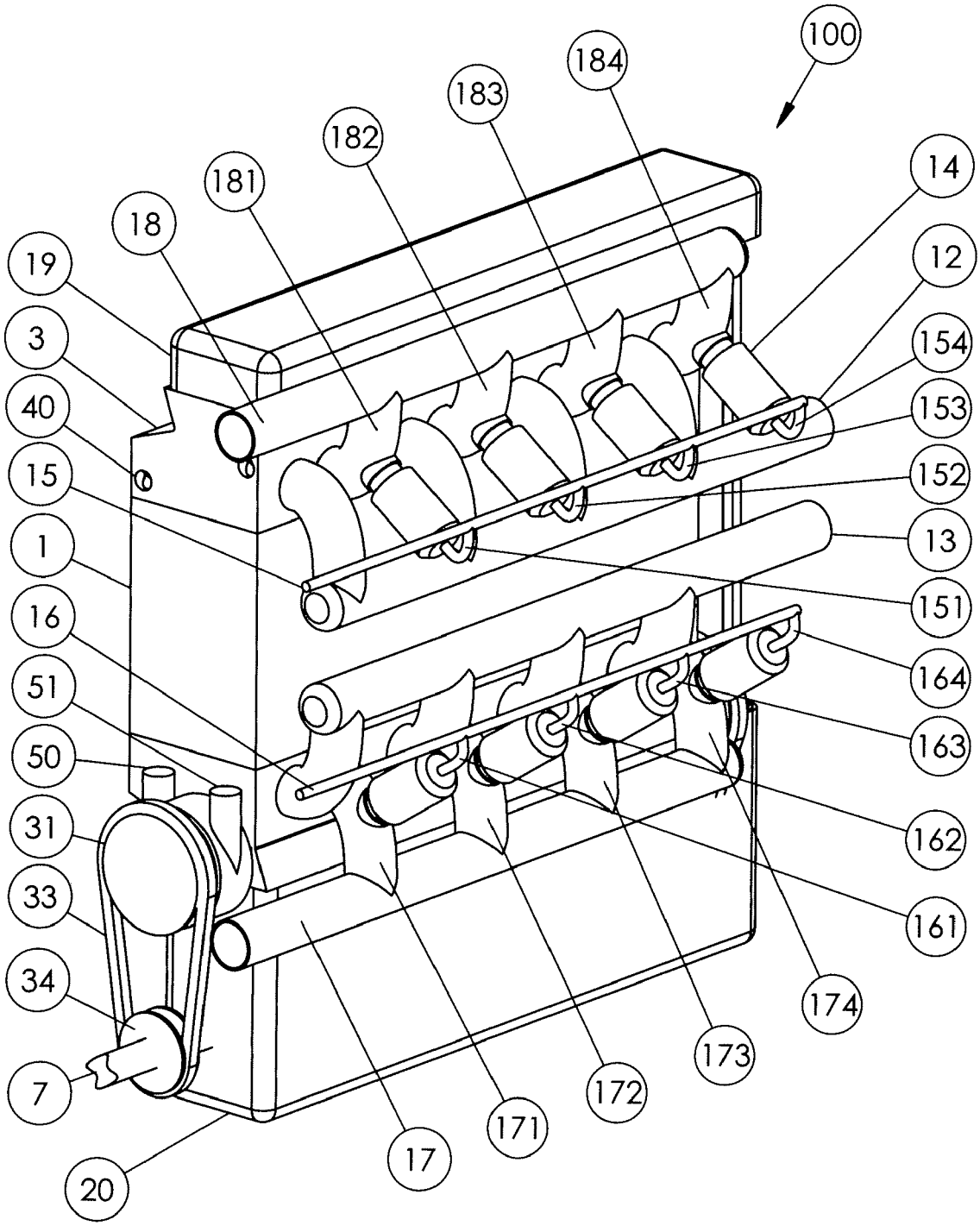
FIG. 1 is a side plan view of a four in line piston engine with eight combustion chambers.
Figure 2:
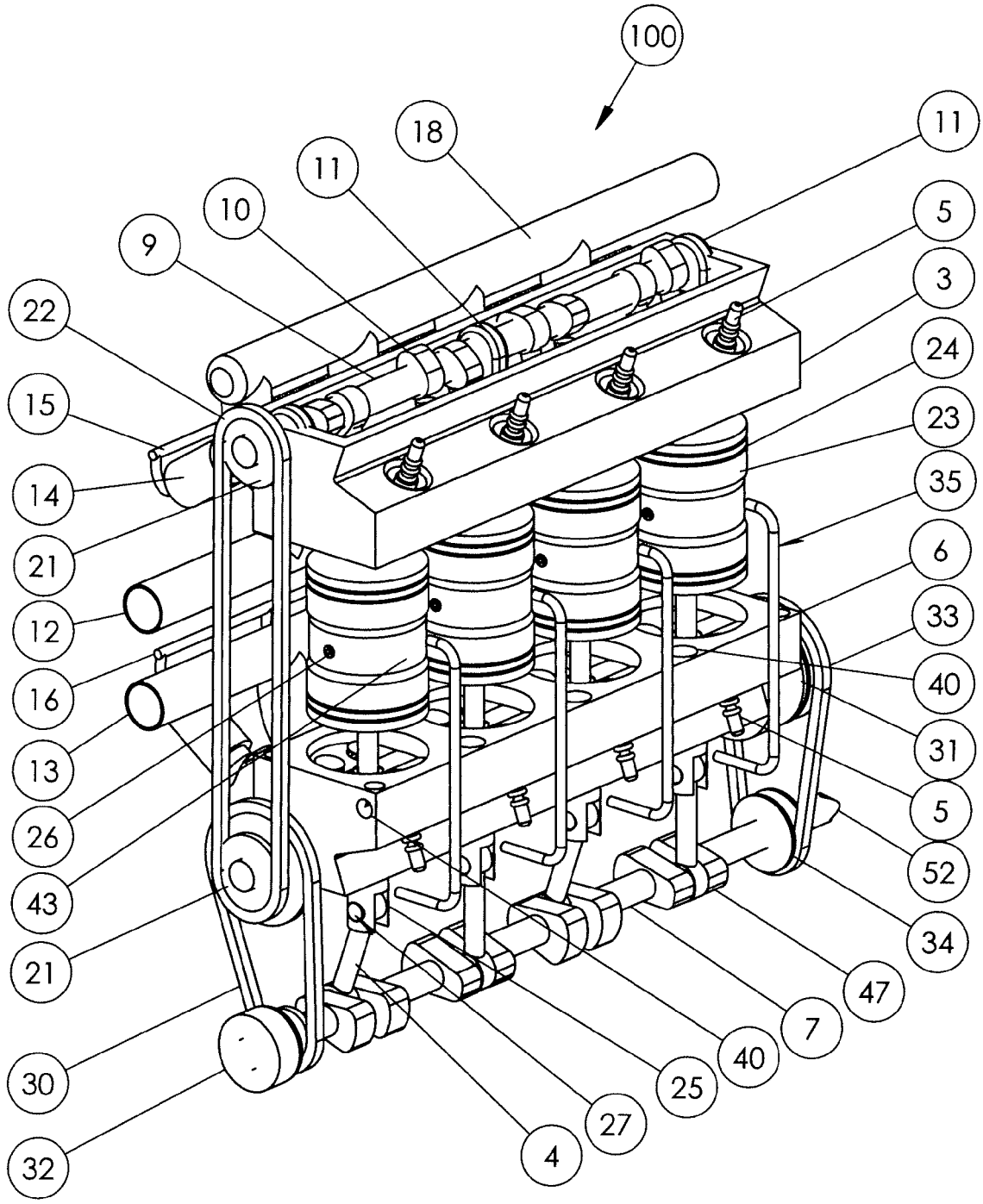
FIG. 2 is a similar view as FIG. 1 with the external housing members removed.

Referring first to FIGS. 1 and 2, a gasoline powered internal combustion engine 100 is shown. Crankshaft 7 delivers the power from the engine 100. A water pump belt 33 and pulley 34 turns the water pump 31 which pumps cooling water through the cylinder heads 3 and 6 in channels 40 for the upper cylinder head 3 and channels 40 for the lower cylinder head 6. The water pump outlet 50 connects to piping (not shown), and the water is returned after it passes through a radiator (not shown) to the water pump inlet 51.

The upper fuel supply line 15 is connected to upper fuel injectors 151, 152, 153 and 154. The lower fuel supply line 16 is connected to lower fuel injectors 161, 162, 163 and 164. The upper air intake manifold 18 feeds each upper cylinder head chamber via inlets 181, 182, 183 and 184. The lower air intake manifold 17 feeds each lower cylinder head chamber via inlets 171, 172, 173 and 174. The upper exhaust manifold 12 exhausts the exhaust gases from each upper cylinder head chamber. The lower exhaust manifold 13 exhausts the exhaust gases from each lower cylinder head chamber. A valve cover 19 covers the upper valves (not shown). The oil pan 20 retains the oil in the crankcase 59.

The upper cam shaft bearing 11 rotates the valve cams 10 in a known manner. The upper valves are not shown. Intake valve I and exhaust valve E for lower chamber 1 LOW are shown. They are controlled by a lower cam shaft bearing and lower valve cams, not shown, which are the same as the upper cam shaft bearing and valve cams. The subsequent lower combustion chambers are labeled 2 LOW, 3 LOW and 4 LOW. The upper combustion chambers are labeled 1 HI, 2 HI, 3 HI and 4 HI. Each combustion chamber has a spark plug 5. A diesel model, not shown, would not need the spark plugs.

A timing chain sprocket 21 drives the timing chain 22 which powers the upper cam shaft 9, bearing 11 and the lower cam shaft and bearing, not shown. The oil pump 32 and the main chain 30 are driven by the crankshaft 7.

The pistons are labeled 23. The central periphery of each piston has an oil relief area 43 to allow crankcase oil to exit from the oil channel/wrist pin 26. The oil then lubricates the cylinder wall and exits the oil return 35. The piston rods 25 each have a vertical oil channel 41 which connects to the oil channel/wrist pin 26. Each piston has two sets of piston rings 24 because each end of the piston supports the pressure of a combustion chamber.

Figure 3:
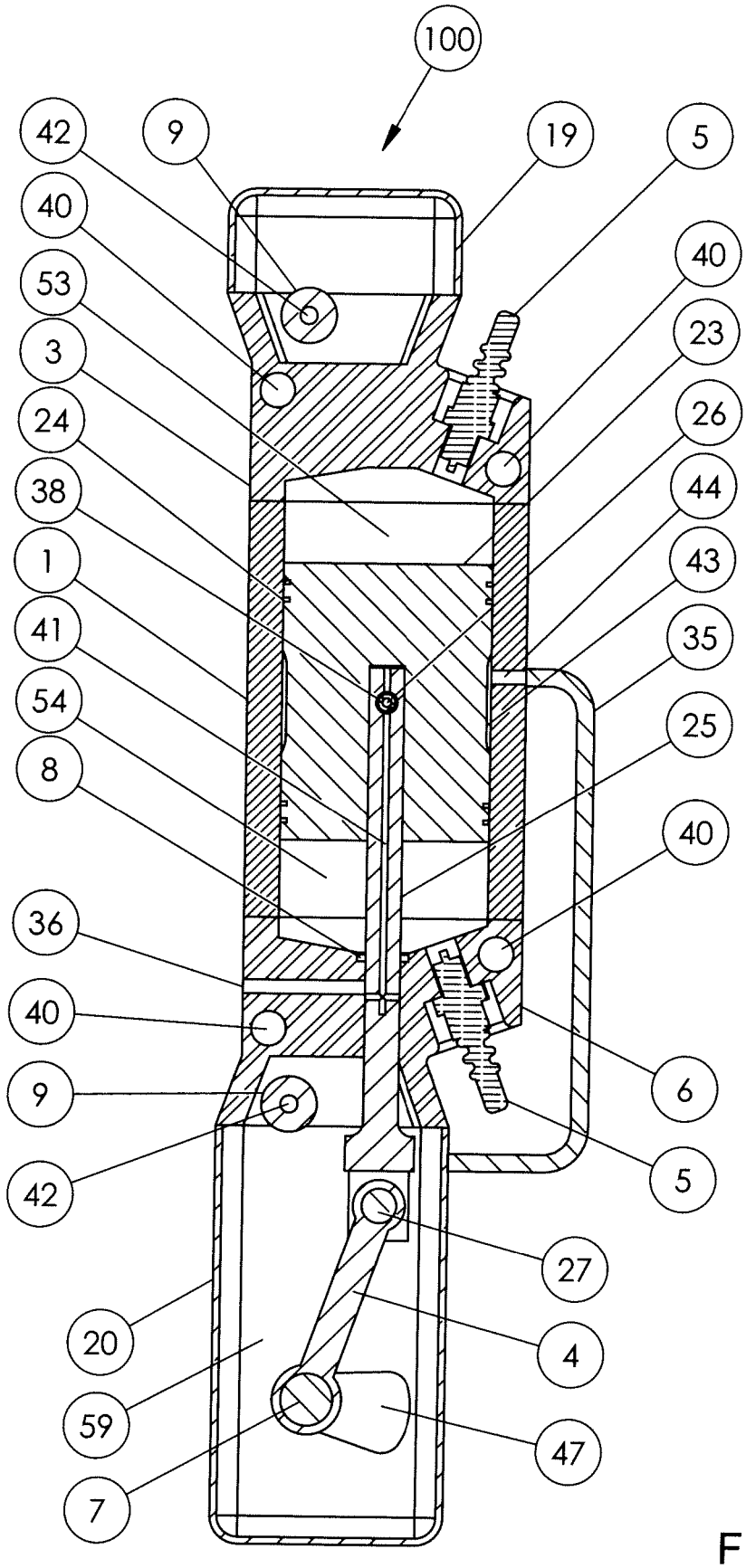
FIG. 3 is a cross-sectional view of one piston taken along line 3-3 of FIG. 1.

In FIG. 3 the engine block 1 has an upper cylinder head 3 and a lower cylinder head 6. The lower cylinder head 6 has high temperature shaft sealing rings 8 to allow for the linear motion of the piston rod 25.

The piston rod 25 connects to the connecting rod 4 via a connector pin 27 and then to the crankshaft 7. Traditional valve springs are not shown.

Oil ducts 42 supply crankcase oil to the cam shaft bearings 11, see FIGS. 2 and 3. The oil pump 32 shown in FIG. 2 supplies oil to the pistons via oil supply channels 36 shown in FIG. 3 wherein connecting lines are not shown.

Figure 4D:
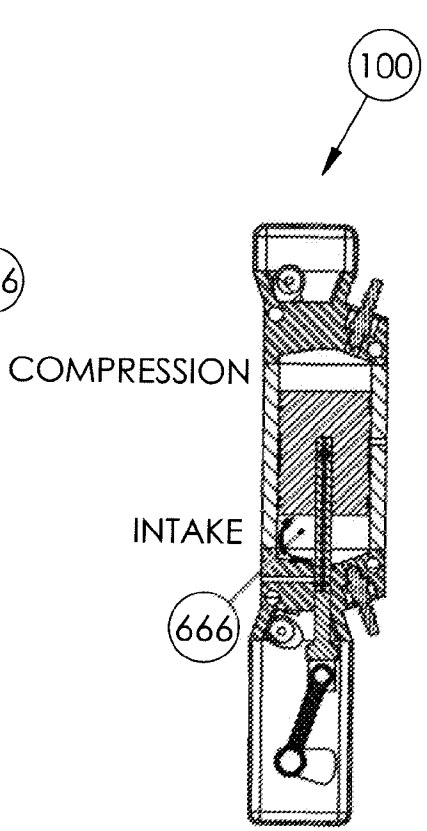
FIG. 4D is a diagrammatic view of the piston in FIG. 3 in a compression/intake stroke.
Figure 4C:
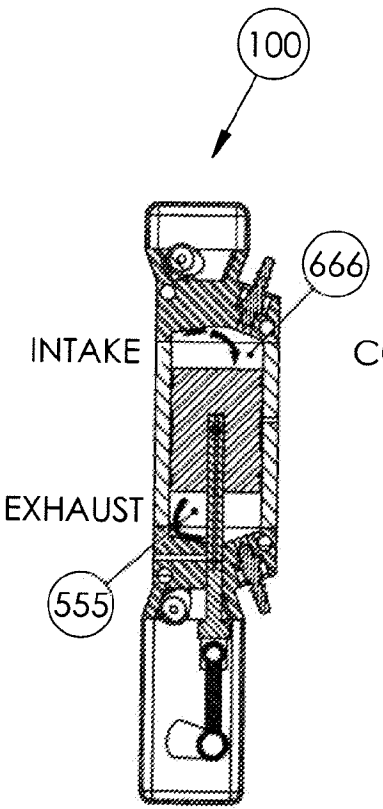
FIG. 4C is a diagrammatic view of the piston in FIG. 3 in an intake/exhaust stroke.
Figure 4B:
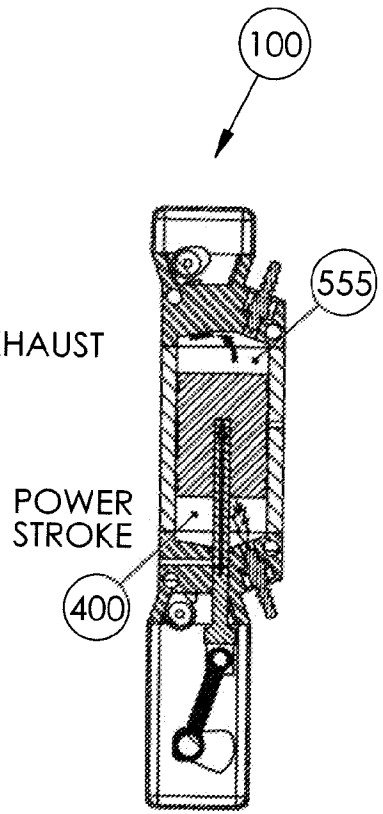
FIG. 4B is a diagrammatic view of the piston in FIG. 3 in an exhaust/power stroke.
Figure 4A:
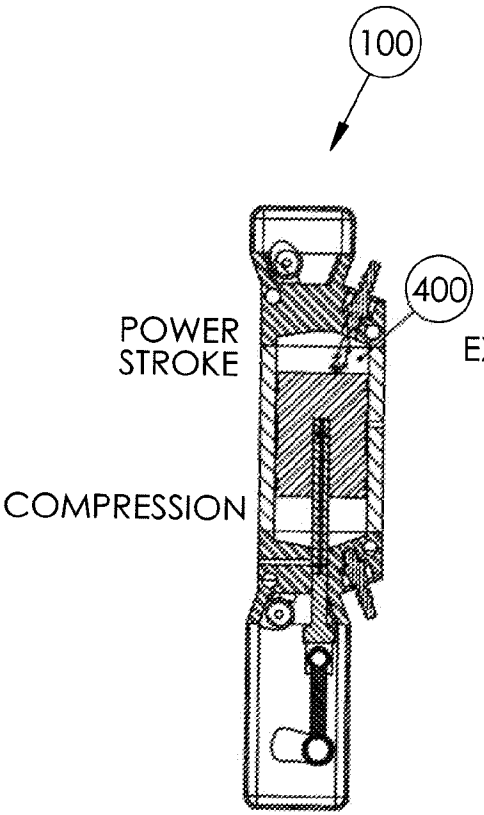
FIG. 4A is a diagrammatic view of the piston in FIG. 3 in a power/compression stroke.

Referring next to FIGS. 4A through 4D, the engine strokes are displayed. FIG. 4A shows the power stroke in the upper combustion chamber 1 HI, where spark plug 5 fires creating explosion 400. The piston 23 is at its top stroke and starts moving down. By moving down, it creates a compression stroke in the lower combustion chamber 1 LOW.

Next in FIG. 4B the exhaust valve E opens in the upper combustion chamber 1 HI creating the exhaust stroke, wherein arrow 555 shows the escaping exhaust fumes. This occurs as the lower combustion chamber goes through its power stroke firing sparkplug 5 causing explosion 400.

Next in FIG. 4C the piston 23 has reached its topmost stroke and is traveling downward, thereby causing an intake stroke in upper combustion chamber 1 HI where intake valve I opens. Arrow 666 shows the combustion mixture entering the upper combustion chamber 1 HI, as exhaust value E opens in 1 LOW.

Then in FIG. 4D the piston 23 moves upward causing the intake stroke in the lower combustion chamber 1 LOW as intake valve I opens and combustion mixture 666 enters the combustion chamber 1 LOW. At the same time the upper combustion chamber 1 HI has its valves I, E closed and is undergoing its compression stroke. The cycle repeats back to the condition shown in FIG. 4A.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

| ITEM NO. | DESCRIPTION |
|---|---|
| 1 | engine block |
| 3 | ported cyclinder head, upper |
| 4 | connecting rod |
| 5 | spark plug |
| 6 | ported cylinder head, lower |
| 7 | crank shaft |
| 8 | sealing ring |
| 9 | cam shaft |
| 10 | valve cam |
| 11 | cam shaft bearing |
| 12 | upper exhaust manifold |
| 13 | lower exhaust manifold |
| 14 | fuel injector |
| 15 | upper fuel supply |
| 151 | upper fuel supply #1 |
| 152 | upper fuel supply #2 |
| 153 | upper fuel supply #3 |
| 154 | upper fuel supply #4 |
| 16 | lower fuel supply |
| 161 | lower fuel supply #1 |
| 162 | lower fuel supply #2 |
| 163 | lower fuel supply #3 |
| 164 | lower fuel supply#4 |
| 17 | lower intake manifold |
| 171 | lower intake manifold #1 |
| 172 | lower intake manifold #2 |
| 173 | lower intake manifold #3 |
| 174 | lower intake manifold #4 |
| 18 | upper intake manifold |
| 181 | upper intake manifold #1 |
| 182 | upper intake manifold #2 |
| 183 | upper intake manifold #3 |
| 184 | upper intake manifold #4 |

-continued

| ITEM NO. | DESCRIPTION |
|---|---|
| 19 | valve cover |
| 20 | oil pan |
| 21 | timing chain sprocket |
| 22 | timing chain |
| 23 | piston |
| 24 | piston ring |
| 25 | piston rod |
| 26 | oil channel in wrist pin |
| 27 | connector pin |
| 30 | main chain |
| 31 | water pump |
| 32 | oil pump |
| 33 | water pump belt |
| 34 | pulley |
| 35 | oil return |
| 36 | oil supply |
| 38 | wrist pin |
| 39 | |
| 40 | cooling water passage |
| 41 | piston rod oil duct |
| 42 | oil duct through cam shaft |
| 43 | oil relief area |
| 44 | oil duct through cylinder block |
| 47 | crank shaft counterweight |
| 48 | |
| 49 | |
| 50 | water pump outlet |
| 51 | water pump inlet |
| 52 | output shaft |
| 53 | upper combustion chamber |
| 54 | lower combustion chamber |
| 55 | |
| 56 | |
| 57 | |
| 58 | |
| 59 | crank case |
| 60 | |
| 61 | |
| 62 | |
| 63 | |
| 64 | |
| 65 | |
| 66 | |
| 67 | |
| 68 | |
| 69 | |
| 100 | engine |
| 400 | combustion |
| 555 | exhaust |
| 666 | intake |

We claim:

1. An internal combustion engine comprising:

a piston having a closed upper end and a closed lower end and traveling linearly through a high temperature seal in a lower cylinder head;

an engine block having an upper and a lower cylinder housing;

said lower cylinder head forming a lower combustion chamber in the lower cylinder housing;

said piston rod connected to a crankshaft via a connecting rod;

an upper cylinder head forming an upper combustion chamber in the upper cylinder housing;

each of said upper and lower combustion chambers having an intake and an exhaust valve, a camshaft to drive the valves and a fuel source; and wherein a first power stroke is initiated by an explosion of a fuel/air mixture in the upper combustion chamber followed by a second power stroke initiated by an explosion of a fuel/air mixture in the lower combustion chamber;

wherein the fuel/air mixture further comprises a gasoline/air mixture, and the engine is a four stroke design with a crankcase housing the crankshaft, and each combustion chamber has a sparkplug;

wherein the piston rod has an oil channel which connects to a piston channel which carries crankcase oil to an interior of each of the upper and the lower cylinder housings;

wherein the piston has an oil relief area around its center in which the piston channel exits;

wherein an oil return line exits from the upper and lower cylinder housings; and wherein the oil return line further comprises an opening in the engine block at a midpoint between the upper and the lower cylinder housings.

2. The engine of claim 1, wherein the engine block has cooling channels for a liquid.

3. The engine of claim 2 further comprising a water pump which pumps the liquid through cooling channels.

4. The engine of claim 1 further comprising four pistons, each piston forming an upper end and a lower end combustion chamber, and each piston connected to the crankshaft.

5. The engine of claim 4 further comprising an exhaust manifold, an intake manifold and a fuel injector for each combustion chamber.

6. The engine of claim 5 further comprising a timing chain sprocket connected to the crankshaft, a timing chain, and an upper and a lower camshaft powered by the timing chain, wherein each camshaft powers a respective set of upper valves and lower valves.

7. The engine of claim 1, wherein the piston further comprises a piston ring near its upper end and a piston ring near its lower end.

8. An internal combustion chamber comprising:

a plurality of pistons housed in an engine block, each of said pistons connected to a crankshaft in a crankcase;

said engine block having an upper and a lower cylinder housing to form an upper and a lower combustion chamber for each piston;

each of said combustion chambers having a fuel/air supply, an intake and an exhaust valve; and each piston having a solid bottom end with a piston rod which travels linearly through a high temperature sliding seal in the lower cylinder head;

wherein each combustion chamber further comprises a sparkplug, and the engine is a four stroke, gasoline fueled engine; and wherein crankcase oil is pumped up a channel in each piston rod and out a side outlet of the piston, and an oil return orifice in the engine block serves as an oil return line to return the oil to the crankcase.

9. The engine of claim 8, wherein each piston has an oil relief area in which the oil side outlet is located.

10. The engine of claim 8 further comprising an upper and a lower camshaft which control an upper and a lower cylinder housing set of valves respectively.

11. The engine of claim 10 further comprising a water pump which pumps a coolant throughout the engine block.

* * * * *